United States Patent [19]

Fleming et al.

[11] 4,145,974

[45] Mar. 27, 1979

[54] PALLET

[75] Inventors: Walter I. Fleming; John P. Coquillard, both of West Dundee, Ill.

[73] Assignee: P. C. B. Inc., Dundee, Ill.

[21] Appl. No.: 873,789

[22] Filed: Jan. 31, 1978

[51] Int. Cl.[2] ..... B65D 19/26

[52] U.S. Cl. ..... 108/51.1; 108/53.3

[58] Field of Search ..... 108/51.1, 51.3, 52.1, 108/53.1, 53.3, 56.1, 57.1

[56] References Cited

U.S. PATENT DOCUMENTS

| | | | |
|---|---|---|---|
| 2,615,661 | 10/1952 | Cushman | 108/53.3 |
| 3,120,825 | 2/1964 | Johnson | 108/53.3 |
| 3,135,228 | 6/1964 | Fleming et al. | 108/51.1 |
| 3,701,326 | 10/1972 | Herman | 108/53.3 |
| 3,720,176 | 3/1973 | Munroe | 108/53.1 X |

FOREIGN PATENT DOCUMENTS

| | | | |
|---|---|---|---|
| 2255223 | 7/1975 | France | 108/51.1 |

*Primary Examiner*—Roy D. Frazier
*Assistant Examiner*—William E. Lyddane
*Attorney, Agent, or Firm*—W. A. Snow

[57] ABSTRACT

A supporting structure for articles for storage for transport wherein provision is made for the same to be elevated by the fork lift of lift trucks on any of the all four sides of the pallet.

4 Claims, 8 Drawing Figures

PALLET

BACKGROUND OF THE INVENTION

This invention is an improvement over U.S. Pat. No. 3,135,228 and the improvement provides for better reinforcement of the pellet deck both longitudinally and transversely.

SUMMARY OF THE INVENTION

A pallet produced from a one-piece base structured from thin layers of tough texture paper laminated on a continuous wood veneer core and formed with spaced parallel corrugations extending in one dimension structured as shown in U.S. Pat. No. 3,130,761. Spaced cutouts are provided in the corrugations or channels whereby stiffening strips are anchored from edge-to-edge of the pallet to the under face of the load bearing surface and through said cutouts and further stiffening strips anchored under the load bearing surface and between the cutouts, whereby the forks of a lift truck may enter beneath the pallet on all sides thereof and the pallets are still nestable.

DETAILED DESCRIPTION OF THE INVENTION

Figure 6:
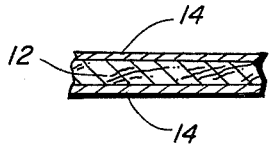
FIG. 6 is an enlarged, fragmental, cross-sectional view of the laminated paper and core.
Figure 5:
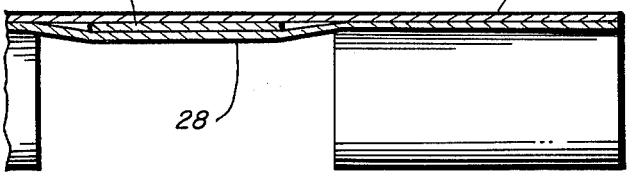
FIG. 5 is a cross-sectional view taken on the lines 5—5 of FIG. 1.

The pallet base element 10 of the present invention, like that shown in U.S. Pat. No. 3,135,228, is constructed as shown in FIG. 6, namely a thin wood veneer core 12 over which paper 14 is overlaid on both sides and glued to the veneer core.

The core 12 of the base element 10 preferably is a wood veneer such as used for the core of plywood. The paper or laminated sheets 14 is preferably a tough-textured paper, such as for example that called "kraft" paper.

The base element 10 is formed with parallel corrugations or channels 16 extending in one dimension of the base element 10.

As herein shown, there are three such corrugations 16, two of them being disposed inwardly adjacent the lateral edges of the base element 10 and the other one being spaced medially between the two laterally disposed corrugations 16. It should be obvious that if a greater width and length pallet were required, more corrugations would be added proportionally, or spacing between them enlarged or reduced.

The main cargo carrying deck 18, as shown in the drawings, is substantially about twice the width of the corrugations 16. Each of the corrugations of the base element 11 is provided with a series of spaced cutouts 20, 21 extending in alignment with both lateral edges of the base element 10, and each is parallelly disposed.

Reinforcing strips 22, 24 of the same material as the base 10 extend through each cutout 20 and below the load bearing surfaces 18 and extend to both the lateral edges 26 thereof. A second series reinforcing strip 28 of the same material as the base 10 extends below the deck 18 from the front edge to the rear edge and both reinforcing strips 22 and 28 are simultaneously anchored to the base element by any suitable means, such as staples 30. Smaller in width reinforcing strips 32, 34 of the same material as the base are anchored from end-to-end and to the under face of the lateral edges 26. These are likewise anchored together by any suitable means, such as by staples 36.

As seen in the drawings, the reinforcing strips 28 and 32 lie below the longitudinally disposed reinforcing strips 22, 24 and are secured thereto.

Figure 1:
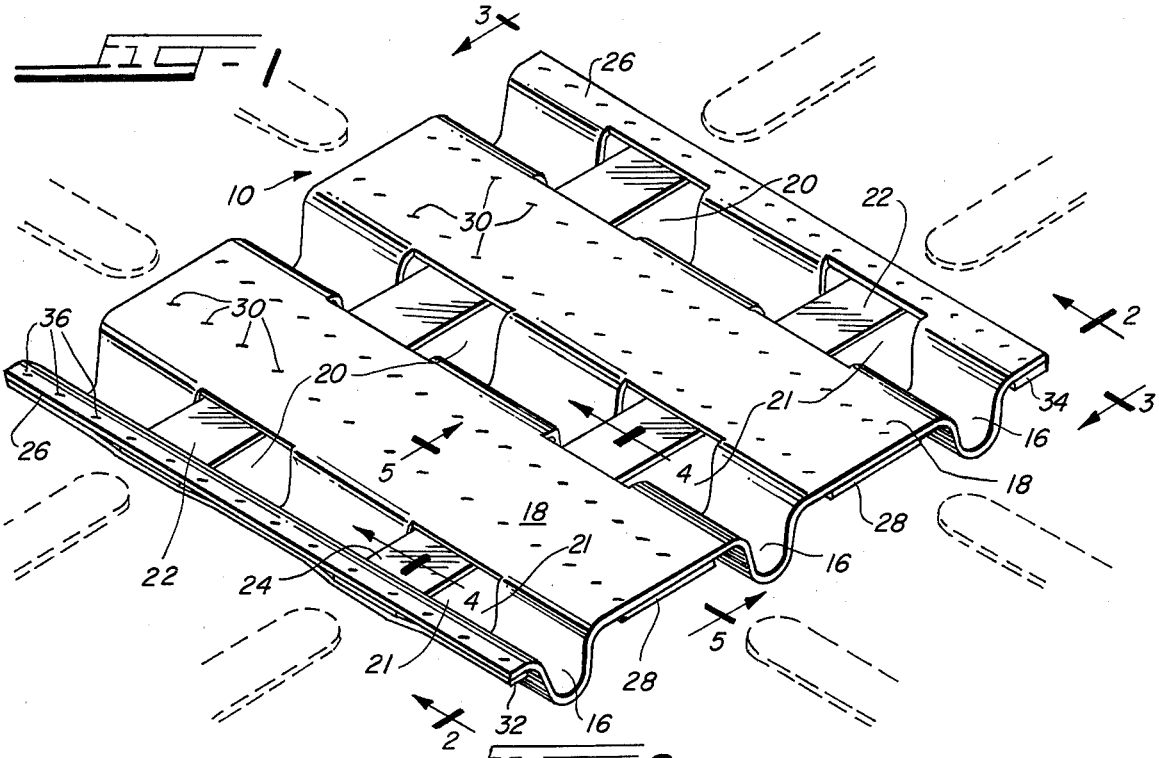
FIG. 1 is a perspective view of the invention.
Figure 2:
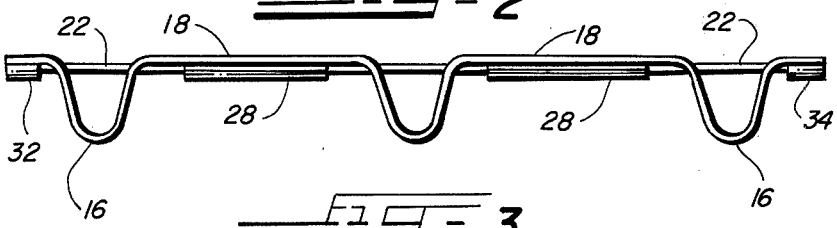
FIG. 2 is an end elevational view taken along the lines 2—2 of FIG. 1.
Figure 3:
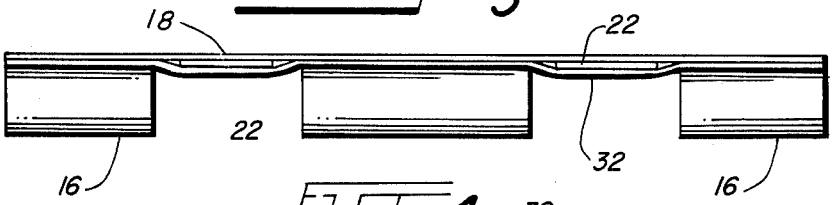
FIG. 3 is a side elevational view taken on the lines 3—3 of FIG. 1.
Figure 4:
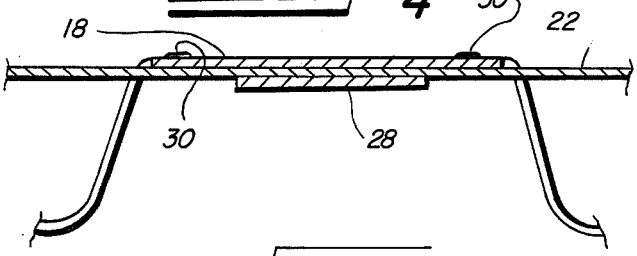
FIG. 4 is a cross-sectional view taken on the lines 4—4 of FIG. 1.

Each of the cutouts 20, 21 is spaced apart so that the fork lifts (shown in phantom) of a lift truck (see FIG. 1) will readily slip therebetween in any of four directions. Also, the deck 18 in the areas on both sides of corrugations 16 is relatively wide whereby the forks of a lift truck may readily enter thereunder from either the front or the back to lift the pallet.

It is thus seen that the pallets are nestable one on another to reduce the space required to store or ship the same.

Figure 7:
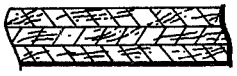
FIG. 7 is an enlarged, fragmental, cross-sectional view of thin veneer strips making up the lamination.

Also, as shown in FIG. 7, the entire pallet construction described above could be made up of two or three thin layers of veneer and the grains in each will run in opposed directions. The layers will be glued or otherwise secured together.

Figure 8:
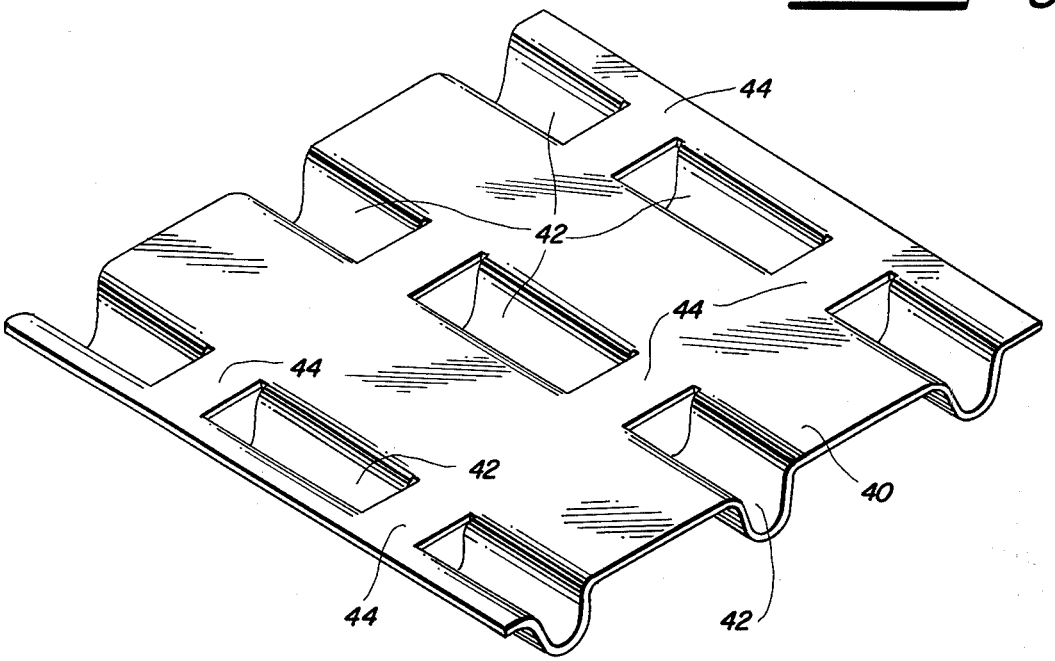
FIG. 8 is a perspective view of a modified form of the invention showing the construction formed of a thin sheet of steel.

Also, as shown in FIG. 8, the entire pallet construction described above could be made up of one plate of thin steel. In this modification, the plate 40 is placed in a stamping press having male and female dies which will stretch the metal to form the corrugations 42 leaving the integral transverse members 44 lying in the plane of the plate 40. Thus, no additional stiffening members are required to keep the pallet from collapsing and a plurality of these units are nestable one in the other.

It will be understood that details of the invention shown may be altered or omitted without departing from the spirit of the invention as defined by the following claims.

We claim:

1. A load supporting pallet comprising a one-piece base element and formed with spaced parallel channels extending in one dimension and having a cargo carrying deck, a pair of longitudinally extending spaced cutouts in each of said channels, the cutouts in each pair being parallelly disposed and aligned, in combination with first rigid reinforcing strips positioned on the under side of the base and extending through each of the parallelly disposed longitudinal cutouts from each of the lateral edges of the base, second rigid reinforcing strips extending transversely from the front to the back edges of the base and against the lower face thereof, said second reinforcing strips positioned under said cargo carrying deck and between each of said channels, and the base element and reinforcing strips being secured together.

2. A load supporting pallet comprising a one-piece base element structured from layers of thin material laminated together and formed with spaced parallel channels extending in one dimension and having a cargo carrying deck, a pair of longitudinally extending spaced cutouts in each of said channels, the cutouts in each pair being parallelly disposed and aligned, in combination with first rigid reinforcing strips of the same material as the base positioned on the under side of the base and extending through each of the parallelly disposed longitudinal cutouts from each of the lateral edges of the base, second rigid reinforcing strips of the same material as the base extending transversely from the front to the back edges of the base and against the lower face thereof, said second reinforcing strips positioned under said cargo carrying deck and between each of said channels, and the base element and reinforcing strips being secured together.

3. A load supporting pallet comprising a one-piece base element structured from layers of tough-textured paper laminated on a continuous wood veneer core and formed with longitudinally extending spaced parallel channels extending in one dimension and having a cargo carrying deck, a pair of spaced cutouts in each of said channels, the cutouts in each pair being parallelly disposed and aligned, in combination with first reinforcing strips of the same material as the base positioned on the under side of the base and extending through each of the parallelly disposed longitudinal cutouts from each of the lateral edges of the base, second reinforcing strips of the same material as the base extending transversely from the front to the back edges of the base and against the lower face thereof, said second reinforcing strips positioned under said cargo carrying deck and between each of said channels, and the base element and reinforcing strips being secured together.

4. The device according to claim 3 wherein the base element is provided with integrally formed lateral edges, third reinforcing strips positioned on the under side of said lateral edges and over the free ends of said first reinforcing strips and secured thereto.

* * * * *